United States Patent [19]

Friedrich et al.

[11] Patent Number: 5,009,992

[45] Date of Patent: Apr. 23, 1991

[54] PHOTOGRAPHIC SILVER HALIDE EMULSION

[75] Inventors: Wolfgang Friedrich, Rödermark; Alfred Wörsching, Rodgau-Jügesheim, both of Fed. Rep. of Germany

[73] Assignee: E. I. DuPont de Nemours and Company, Wilmington, Del.

[21] Appl. No.: 453,833

[22] Filed: Dec. 20, 1989

[30] Foreign Application Priority Data

Jan. 18, 1989 [DE] Fed. Rep. of Germany ..... 3901268

[51] Int. Cl.[5] ..... G03C 1/02

[52] U.S. Cl. ..... 430/573; 430/572; 430/576; 430/944

[58] Field of Search ..... 430/611, 572, 573, 576, 430/944

[56] References Cited

U.S. PATENT DOCUMENTS

| | | | |
|---|---|---|---|
| 2,394,198 | 2/1946 | Mueller | 95/7 |
| 4,198,240 | 4/1980 | Mikawa | 430/611 |
| 4,596,767 | 6/1986 | Mihara et al. | 430/576 |
| 4,960,689 | 10/1990 | Nishikawa et al. | 430/611 |

FOREIGN PATENT DOCUMENTS

| | | | |
|---|---|---|---|
| 203698 | 12/1986 | European Pat. Off. . | |
| 0293917 | 12/1988 | European Pat. Off. | 430/576 |

*Primary Examiner*—Charles L. Bowers, Jr.
*Assistant Examiner*—Thomas R. Neville

[57] ABSTRACT

Photographic silver halide emulsion, sensitized for infrared spectral region, containing an aromatic thiosulfonic acid or a salt of the acid. The emulsion is useful for preparing photographic elements having sensitivity in the infrared spectral region.

10 Claims, No Drawings

PHOTOGRAPHIC SILVER HALIDE EMULSION

DESCRIPTION

1. Technical Field

This invention relates to a photographic silver halide emulsion for the production of recording materials for the infrared spectral region.

2. Background of the Invention

Image recording devices have been developed recently, in which the image is written by a fine light beam produced by a semiconductor laser. The radiation emitted by efficient laser diodes lies in the near infrared. Therefore, a need exists for infrared-sensitive recording materials that are suitable for this type of exposure For this purpose, it is particularly important that the laser beam exposes each surface element of the recording material for only a very short time (about 100 ns) in the recording step and that the laser energy is limited. Therefore, materials with high infrared sensitivity on short exposure are primarily required. Furthermore, the lowest possible sensitivity in the visible spectral region is desirable for ease in handling.

These objectives were pursued until now essentially by two different routes. One route attempted to achieve more effective sensitization of silver halide to the infrared region by the preparation of new sensitizing dyes. The most practically significant class of dyes for this purpose is represented by the structural formula for heptamethine cyanines. The other route proposed special emulsion additives, by which the infrared sensitivity achieved with a specific dye could be increased further. Examples of such additives are triazine derivatives (U.S. Pat. No. 3,695,888 and German Patent Publ. No. 37 20 138), mercapto compounds (U.S. Pat. No. 3,457,038), and combinations of polyethyl acrylate with mercapto compounds or stilbenes (European Patent 203 698).

The effect of such so-called supersensitizing additives is, however, not uniform, but rather can be variable depending on the type of sensitizing dye and emulsion. Therefore, the need for additional supersensitizing dyes for the infrared region still exists. A successful increase in infrared sensitivity would be a significant technical advance. For the same laser light output, recording could be accelerated.

It is desired that photographic silver halide emulsions be prepared that yield infrared recording materials with higher sensitivity. It is also desired that emulsion additives be prepared that act in a supersensitizing manner on the infrared sensitivity of silver halide materials.

SUMMARY OF THE INVENTION

In accordance with this invention there is provided a photographic silver halide emulsion, sensitized for the infrared spectral region, containing an aromatic thiosulfonic acid or a salt of the acid in amount of from 0.1 to 5 millimoles per mole of silver halide.

DETAILED DESCRIPTION OF THE INVENTION

Such aromatic thiosulfonic acids are indeed known as emulsion additives for recording materials for the visible spectral region. However, they are described for their effect in such emulsions solely as "clarity retainers", that is, antifogging agents in gold sensitization or together with aromatic sulfinic acids (DD 7 376; U.S. Pat. No. 2,394,198). A newer Japanese patent application (JP 57 176 032, filed Apr. 23, 1981; cited in Chemical Abstracts 100:42996) also describes the use of sodium thiotosylate (Compound I-2, see below) in the physical ripening of emulsions that were then sensitized with mono-, tri- or pentamethine cyanines for visible light. European Patent 293 917 describes the use of thiosulfonic acids, their salts and esters as clarity retainers in color film emulsions. However, it was not known until the present invention that aromatic thiosulfonic acids confer a supersensitizing effect in infrared-sensitized emulsions. As these compounds were previously described only as antifogging agents and stabilizers in emulsions sensitized for visible light, this effect is surprising to the expert. It was further established that the effect of the invention stems only from thiosulfonic acids and their salts, but not, however, from other substances, such as thiosulfonic acid esters, structurally related to these compounds and described in the current state of the art (German Patent 28 24 082-C2, European Patent 293 917-A2) as clarity retainers or antifoggant agents. Furthermore, the expert would not have anticipated the super sensitizing effect in infrared-sensitized emulsions by said aromatic thiosulfonic acids or salts thereof from a reasonable assessment of the current state of the art.

Preferred thiosulfonic acids and salts for emulsions of the invention are represented by the general formula (I)

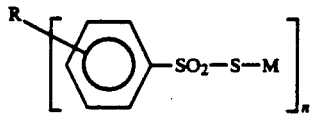

(I)

wherein R signifies a monovalent, optionally also divalent, alkyl, aryl or aralkyl radical with 1 to 10 carbon atoms, or hydrogen, M is a cation, preferably alkali metal or ammonium, and n is the number 1 or 2.

Examples of useful aromatic thiosulfonic acids and their salts of the invention include:

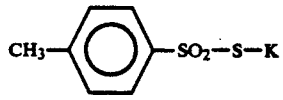

(I-1)

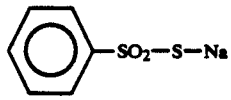

(I-2)

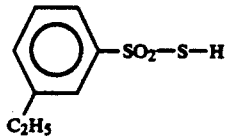

(I-3)

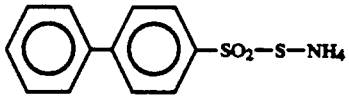

(I-4)

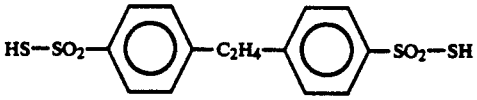

(I-5)

-continued

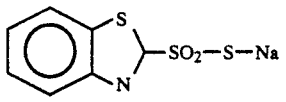

To achieve the supersensitization of the invention, the thiosulfonic acids or their salts must be used in quantities that are considerably higher than described for the clarityretaining effect in the current state of the art. Additions of 0.1 to 5 millimoles per mole of silver halide are generally adequate. The range between 0.2 and 2 millimoles per mole of silver halide is particularly preferred.

The emulsions of the invention contain a suitable sensitizing dye in sensitizing amounts to sensitize in the infrared spectral region. The amount is dependent on the sensitizing dye and silver halide emulsion present. Generally used for this purpose are cyanine dyes that contain more than five optionally substituted methine groups (so-called polymethine cyanines). Heptamethine cyanines are preferred, because they sensitize in the near infrared region, which is used for sensitize in the near infrared region, which is used for recording primarily on account of the low, thermal sweep radiation and the available, low-priced semiconductor lasers.

Particularly preferred sensitizers can be represented by the general formula (II).

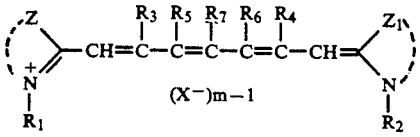

(II)

In this formula, $R_1$ and $R_2$, which can be identical or different, signify respectively an alkyl group, e.g., 1 to 8 carbon atoms, or a substituted alkyl group, e.g., 1 to 6 carbon atoms substituted with carboxy, sulfo, cyano, halogen, hydroxy, alkoxycarbonyl, alkoxy, aryloxy, acyloxy, acyl, carbamoyl, sulfamoy, aryl, etc.

$R_3$ and $R_4$, which can be identical or different, signify respectively a hydrogen atom, a lower alkyl group, e.g., 1 to 5 carbon atoms, a lower alkoxy group, e.g., 1 to 5 carbon atoms, a phenyl group or a benzyl group;

$R_5$ and $R_6$ both signify respectively a hydrogen atom or if linked together, a divalent alkylene group;

$R_7$ signifies a hydrogen atom, a lower alkyl group, e.g., 1 to 5 carbon atoms, a lower alkoxy group, e.g., 1 to 5 carbon atoms, a phenyl group, a benzyl group or

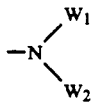

wherein $W_1$ and $W_2$, which can be identical or different, represent respectively a substituted or non-substituted group, e.g., as noted above for $R_1$ and $R_2$, provided that $W_1$ and $W_2$ can be linked together to form a 5 or 6 member, nitrogen-containing, heterocyclic ring; or wherein:

$R_3$ and $R_7$ can be linked together to form a divalent alkylene group;

Z and $Z_1$, which can be identical or different, signify respectively a group of non-metallic atoms required to form a 5 or 6 member, nitrogen-containing, heterocyclic ring;

$X^-$ signifies an acid anion; and m signifies the number 1 or 2.

Examples of suitable infrared sensitizers are the compounds (II-1)

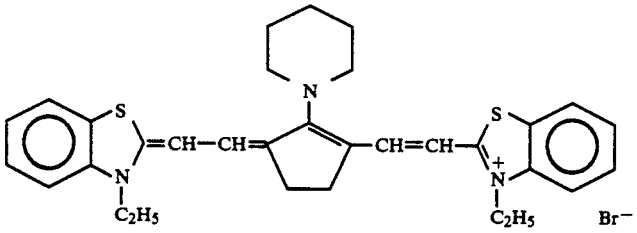

(II-2)

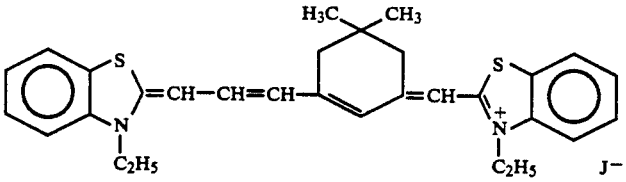

(II-3)

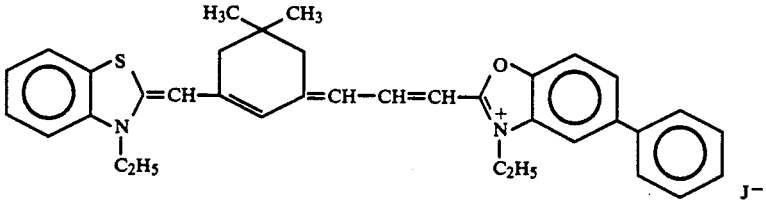

-continued (II-4)

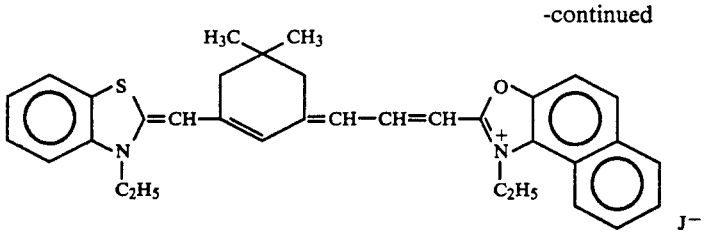

(II-5)

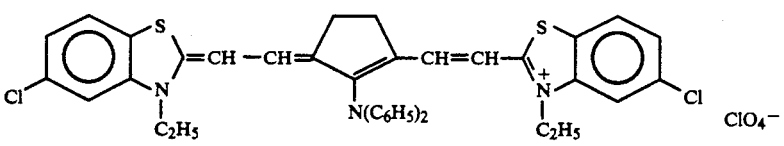

(II-6)

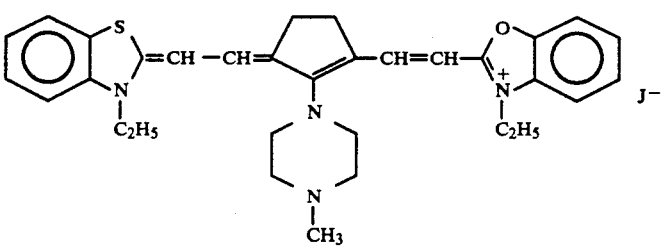

(II-7)

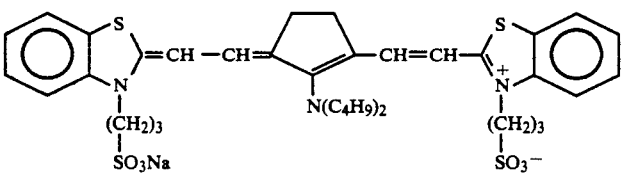

(II-8)

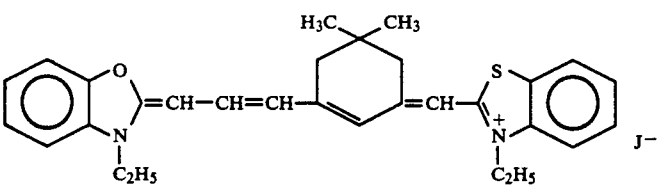

The silver halide of the emulsions of the invention can be silver chlorobromide, silver bromoiodide, silver chloroiodide or silver chlorobromoiodide. Silver chlorobromides are preferred with a chloride proportion of at least 70 mole percent, which may also contain a small proportion of iodide, and silver bromoiodide with an iodide proportion of 10 mole percent maximum. The crystal form can be polyhedral, platelike, spherical, cubic or irregular; the grain size distribution can be polydisperse or monodisperse. The grains can also have a core-shell structure. A preferred embodiment uses a monodisperse cubic emulsion with a grain size between 0.05 and 1.0 μm or substantially uniform size. Methods of preparing the emulsions with specific grain shape, grain size and grain distribution are known to the expert.

The chemical ripening can done with the known processes of sulfur, noble metal or reduction sensitization or also with appropriate combinations of these processes. The aromatic thiosulfonic acids of the invention can be added before, during or after chemical ripening. If they are present in the emulsion during chemical ripening, they also act in the known manner as clarity retainers or antifogging agents.

The infrared sensitizers are added to the emulsion preferably after chemical ripening or shortly before coating onto the base. However, if they are sufficiently stable, they can also be used in earlier stages of emulsion preparation.

The emulsions and the recording materials prepared therefrom can contain additional known agents to adjust certain properties, for example, antifogging agents, agents to improve storage stability, polymer dispersions (to improve dimensional stability of the recording materials), hardening agents, coating aids, matting agents, etc.

The emulsions of the invention yield photographic recording materials with superior infrared sensitivity. The contrast of the emulsion is not changed significantly by the addition of the thiosulfonic acid. Suitable thiosulfonic acids or their salts for practice of the invention are easily obtainable.

The invention can be used to produce infrared-sensitive, photographic recording materials, for example, for recording with a scanning laser beam in reprography or medical diagnostics, as well as for imagewise photography.

EXAMPLES

The following examples of embodiments serve to explain the invention in detail. In these examples, all quantities of emulsion additives are related respectively to 1 mole of silver halide; the addition takes place, unless otherwise specified, in dissolved form.

EXAMPLE 1

A monodisperse silver chlorobromide emulsion with a chloride proportion of 70 mole percent was prepared by pAg-controlled double jet precipitation. This emulsion had cubic grains with an edge length of 0.22 μm. After removal of the soluble salts by flocculation and washing, the emulsion was subjected to combined sulfur and gold ripening. Before the beginning of chemical ripening, 133 mg of compound I-1 were added.

Ripening was terminated by the addition of 270 mg 4-hydroxy-6-methyl-1,3,3*a*,7-tetraazaindene. Before the emulsion was coated on a polyethylene terephthalate base provided with an antihalation backing, 1.1 g saponin and 17 mg of sensitizer II-2 were added to the emulsion. A gelatin protective layer, which contained a hardening agent and additional coating aids, was coated simultaneously with the emulsion. The resulting recording material contained on the recording side 2.6 g silver and 3.8 g gelatin per square meter.

A comparison test was conducted with the same process, but without the addition of compound I-1.

The material thus obtained was exposed in a sensitometer with an exposure time of 1 ms through interference filters with transmission peaks at 407 and 798 or 830 nm and processed in 90 s total time at 34° C. development temperature in an x-ray roll developing machine supplied with commercial solutions. For evaluation of sensitivity, the reciprocal of the exposure required for a density of 1.0 over minimum density (fog + base) was determined and related to the value 100 for the comparison test. The test result is shown in Table 1 below.

TABLE 1

| Emulsion | Sensitivity at 407 nm | Sensitivity at 830 nm |
|---|---|---|
| With 133 mg compound I-1 | 89 | 140 |
| Comparison | 100 | 100 |

EXAMPLE 2

The test in Example 1 was repeated, but 200 mg nonyl phenol ethoxylate (10 moles ethylene oxide per mole phenol) were added to each of the test emulsion and comparison emulsion. The result is given in Table 2 below.

TABLE 2

| Emulsion Additives | | Sensitivity at | |
|---|---|---|---|
| Compound I-1 | Nonyl Phenol Ethoxylate | 407 nm | 830 nm |
| — | 200 mg | 100 | 100 |
| 133 mg | 200 mg | 88 | 130 |

EXAMPLE 3

The test in Example 1 was repeated so that all samples contained nonyl phenol ethoxylate, but a polyethyl acrylate latex with 30 percent by weight solids content was also added. The results are shown in Table 3 below.

TABLE 3

| Emulsion Additives | | Sensitivity at | |
|---|---|---|---|
| Compound I-1 | Latex | 407 nm | 830 nm |
| 200 mg | — | 78 | 200 |

TABLE 3-continued

| Emulsion Additives | | Sensitivity at | |
|---|---|---|---|
| Compound I-1 | Latex | 407 nm | 830 nm |
| — | 11 mg | 100 | 167 |
| 200 mg | 11 mg | 67 | 218 |
| — | — | 100 | 100 |

EXAMPLE 4

A monodisperse silver chlorobromide emulsion with 80 mole percent chloride and cubic grains of 0.23 μm edge length was prepared by pAg-controlled double jet precipitation. 0.052 mg rhodium (III) chloride had been added to the precipitation mixture. The emulsion was subjected to a flocculation-wash process and a combined gold-sulfur sensitization. Before digestion, 140 mg sodium toluene sulfonate and optionally, compound I-2 were added; after digestion, 400 mg 4-hydroxy-6-methyl-1,3,3*a*,7-tetraazaindene, 70 mg benzotriazole, 750 mg sodium octyl phenyl di(oxyethyl)sulfonate, 25 mg of sensitizer II-1 and optionally, 65 g of the latex of Example 3 were added. The emulsion was coated, together with a gelatin protective layer on a base as described in Example 1. The recording material thus prepared contained on the recording side 4.3 g silver and 3.5 g gelatin per square meter.

The material was exposed as described in Example 1 and processed in a roll developing machine for photo typesetting material with a conventional commercial rapid developer of the hydroquinone-phenidone type at 34° C. in 120 seconds total time. To judge sensitivity, the reciprocal of the exposure required for a density of 3.0 above minimum density was determined and related for each wave length to the value 100 for the comparison test. The result is shown in Table 4 below.

TABLE 4

| Emulsion Additive | | Sensitivity at | |
|---|---|---|---|
| Compound I-1 | Latex | 407 nm | 830 nm |
| — | — | 100 | 100 |
| — | 65 g | 89 | 200 |
| 140 mg | — | 59 | 282 |
| 140 mg | 65 g | 62 | 479 |

Examples 3 and 4 indicate that, also in the presence of known supersensitizing additives, sensitivity is increased even further by addition, in accordance with the invention, of the aromatic thiosulfonate.

EXAMPLE 5

Tests were conducted in accordance with the comparison test of Example 4, in which tests the emulsion was sensitized with various sensitizers for the green, red and infrared spectral region, with and without addition of 75 mg of compound I-1. Sensitivity was determined for each sensitizer at 407 nm and at maximum sensitization. Table 5 below shows sensitivities for the test films containing compound I-1 relative to the value 100 for the films without this compound, but with the same sensitization.

Table 5

| Sensitizer | Sensitivity at 407 nm | Maximum Sensitivity | Sensitization Maximum (nm) |
|---|---|---|---|
| Compound II-2 | 65 | 209 | 820 |
| Compound II-1 | 72 | 195 | 760 |
| Compound A | 81 | 78 | 630 |
| Compound B | 68 | 100 | 620 |

Table 5-continued

| Sensitizer | Sensitivity at 407 nm | Maximum Sensitivity | Sensitization Maximum (nm) |
|---|---|---|---|
| Compound C | 68 | 95 | 530 |
| Compound D | 66 | 97 | 500 |

Compound A

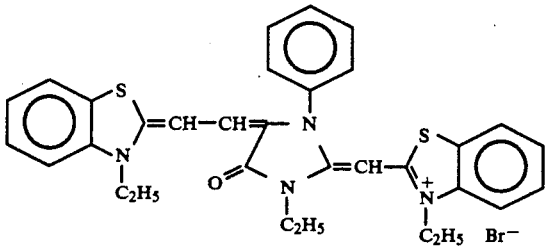

Compound B

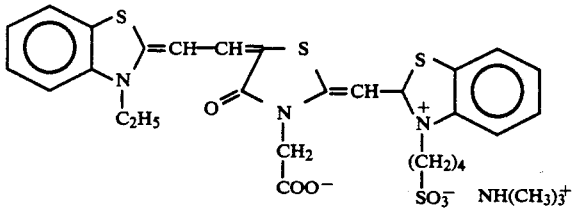

Compound C

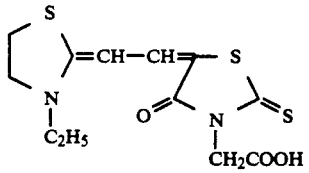

Compound D

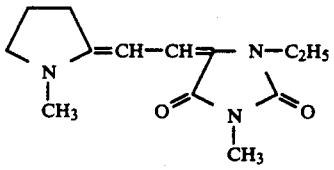

It is evident in these results that the aromatic thiosulfonic acids increase sensitivity only in infrared-sensitized emulsions, whereas, in sensitization in the visible range, sensitivity is decreased by these compounds in the known manner, or in the best case, remains unchanged.

What is claimed is:

1. Photographic silver halide emulsion consisting essentially of said emulsion containing therein a dye present in a sensitizing amount to sensitize the emulsion for the infrared spectral region, and an aromatic thiosulfonic acid or a salt of the acid in amount of from 0.1 to 5 millimoles per mole of silver halide.

2. Photographic silver halide emulsion according to claim 1 wherein the aromatic thiosulfonic acid or its salt is described by the general formula (I)

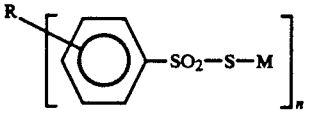

(I)

wherein R is a monovalent or divalent alkyl, aryl or aralkyl radical with 1-10 carbon atoms or hydrogen, M is a cation and n is 1 or 2.

3. Photographic silver halide emulsion according to claim 1 wherein the aromatic thiosulfonic acid or its salt is present in an amount of from 0.2 to 2 millimoles per mole silver halide.

4. Photographic silver halide emulsion according to claim 1 wherein a heptamethine cyanine dye is present as infrared sensitizer.

5. Photographic silver halide emulsion according to claim 4 wherein the sensitizing dye is of the general formula:

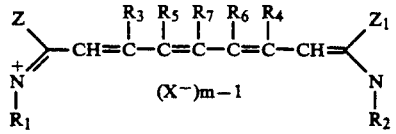

wherein $R_1$ and $R_2$, which can be identical or different, signify respectively an alkyl group or a substituted alkyl group;

$R_3$ and $R_4$, which can be identical or different, signify respectively a hydrogen atom, a lower alkyl group, a lower alkoxy group, a phenyl group or a benzyl group;

$R_5$ and $R_6$ both signify respectively a hydrogen atom or if linked together, a divalent alkylene group;

$R_7$ signifies a hydrogen atom, a lower alkyl group, a lower alkoxy group, a benzyl group or

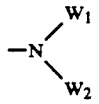

wherein $W_1$ and $W_2$, which can be identical or different, represent respectively a substituted or non-substituted alkyl group or a substituted or non-substituted aryl group, provided that $W_1$ and $W_2$ can be linked together to form a 5 or 6 member, nitrogen-containing, heterocyclic ring; or wherein:

$R_3$ and $R_7$ can be linked together to form a divalent alkylene group;

Z and $Z_1$, which can be identical or different, signify respectively a group of non-metallic atoms required to form a 5 or 6 member, nitrogen-containing, heterocyclic ring;

$X^-$ signifies an acid anion; and m signifies the number 1 or 2.

6. Photographic silver halide emulsion according to claim 1 wherein the silver halide contains at least 70 mole percent silver chloride.

7. Photographic silver halide emulsion according to claim 1 wherein the aromatic thiosulfonic acid is p-toluene thiosulfonic acid.

8. Photographic silver halide emulsion according to claim 1 wherein the silver halide is present in the form of cubic crystals of substantially uniform size.

9. Process for the preparation of an infrared-sensitized photographic silver halide emulsion according to claim 1 wherein the aromatic thiosulfonic acid or a salt of such an acid is added before the start of chemical ripening.

10. A photographic silver halide element comprising a support having coated thereon a photographic silver halide emulsion according to claim 1.

* * * * *